US005465460A

United States Patent [19]

Cantone

[11] Patent Number: 5,465,460

[45] Date of Patent: Nov. 14, 1995

[54] DOORSTOP

[76] Inventor: Giovanni Cantone, 1538 74th St., Brooklyn, N.Y. 11228

[21] Appl. No.: 297,092

[22] Filed: Aug. 29, 1994

[51] Int. Cl.[6] ..... E05F 5/02

[52] U.S. Cl. ..... 16/82; 292/DIG. 15; 292/DIG. 19

[58] Field of Search ..... 49/70; 292/DIG. 15, 292/DIG. 19, 255; 16/82

[56] References Cited

U.S. PATENT DOCUMENTS

| | | | |
|---|---|---|---|
| 3,805,322 | 4/1974 | Serrano | 16/82 |
| 3,818,637 | 6/1974 | Vivier | 16/82 X |
| 4,216,986 | 8/1980 | McNinch et al. | 16/82 X |
| 4,631,776 | 12/1986 | King | 292/DIG. 15 |
| 4,797,970 | 1/1989 | Charlton | 16/82 |

FOREIGN PATENT DOCUMENTS

| | | | |
|---|---|---|---|
| 383822 | 1/1965 | Switzerland | 16/82 |
| 483104 | 10/1938 | United Kingdom | 292/DIG. 19 |
| 1358603 | 7/1974 | United Kingdom | 292/DIG. 15 |

*Primary Examiner*—Peter M. Cuomo
*Assistant Examiner*—Jerry Redman
*Attorney, Agent, or Firm*—Victor M. Serby

[57] ABSTRACT

A doorstop having a housing contains a striker block slideably mounted in the housing. The striker block is biased in a first position where it engages a spring loaded door restraining member holding the door restraining member in a down position. When the striker block is moved into a second position against its biasing force, the striker block disengages the spring loaded door restraining member and the door restraining member is urged into an up position. A force applied to the door restraining member sufficient to overcome the spring and biasing forces, will return the door restraining member to its down position, the biasing force will return the striker block to its first position and engage the door restraining member and hold it in the down position.

4 Claims, 2 Drawing Sheets

DOORSTOP

BACKGROUND OF THE INVENTION

This invention is concerned with floor mounted doorstops of the type which keep a door from closing.

Doorstops of the type which keep a door ajar exist in the art. A simple weight placed in the path of the closing door or a wedge interposed between the bottom of the door and the floor, are the classic types of doorstops and have been used since antiquity. An eyebolt attached to a door with a mating hook attached to the floor (or vice versa) to engage the eyebolt when the door is in the open position is another way doors are kept open in the art. The problem with these devices is that the user must usually stoop or use his foot in an awkward manner to set the door in the ajar position or to remove the stop to shut the door. Also, these devices if used in commercial buildings on door intended to be fire partitions, violate the applicable codes.

The issued patents with respect to doorstops fall into two main types, those intended to keep a door ajar and those intended to prevent forced entry by limiting the amount that the door may be opened. U.S. Pat. No. 5,123,685 is an example of a device which falls into the former category. U.S. Pat. No. 5,120,093 is an example of the plurality of floor mounted doorstops that exist in the art. U.S. Pat. Nos. 5,018241 and 3,805,322 are examples of foot operated doorstops. U.S. Pat. No. 5,226,201 shows a doorstop of the type designed to retain a door in the open position by retaining the door between an abutment and a stopping portion. U.S. Pat. No. 1,936,232 shows a self catching doorstop which is released by one's foot. U.S. Pat. No. 2,189,274 shows a self catching doorstop which swivels into position to trap a door against closing. Each of these devices has particular problems which must be overcome for an effective and easy to use doorstop.

What is needed is a doorstop which is mounted flush with the floor, of the type which keeps a door open, sets itself automatically upon opening the door, and is released by a simple step of the foot without a twisting motion, at a sufficient distance from the door so that one's shoe does not scuff the door. Easy removal of the doorstop from its mounting for cleaning purposes and adaptability to automatic release of the door by a fire signaling system are also needs.

SUMMARY OF INVENTION

A doorstop designed to be embedded in the floor which is easy to produce, sets itself automatically upon opening the door, and is released by a simple step of the foot is disclosed. A second preferred embodiment of the doorstop allows release of the doorstop in response to a signal from a fire signaling system.

A doorstop having a housing contains a striker block slideably mounted in the housing. The striker block is biased in a first position where it engages a spring loaded door restraining member holding the door restraining member in a down position. When the striker block is moved into a second position against its biasing force, the striker block disengages the spring loaded door restraining member and said member is urged into an up position. A force applied to the door restraining member sufficient to overcome the spring and biasing forces, will return the door restraining member to its down position, the biasing force will return the striker block to its first position and engage the door restraining member and hold it in the down position.

When this device is installed in the floor in the path of a swinging door it is positioned so that opening the door fully will cause the door to swing over the door restraining member, hit the striker block, and move the striker block into its second position. The spring loaded door restraining member will then be urged into its up position, trapping the door between the striker block and the door restraining member and prevent the door from closing. To release the door, one simply steps on the door restraining member, returning it to its down position, the striker block will return to its first position engaging the door restraining member in its down position and allowing the door to close freely.

An optional solenoid may be installed between the housing and the door restraining member so that energizing the solenoid returns the door restraining member to its down position.

DESCRIPTION OF PREFERRED EMBODIMENT

Figure 1:
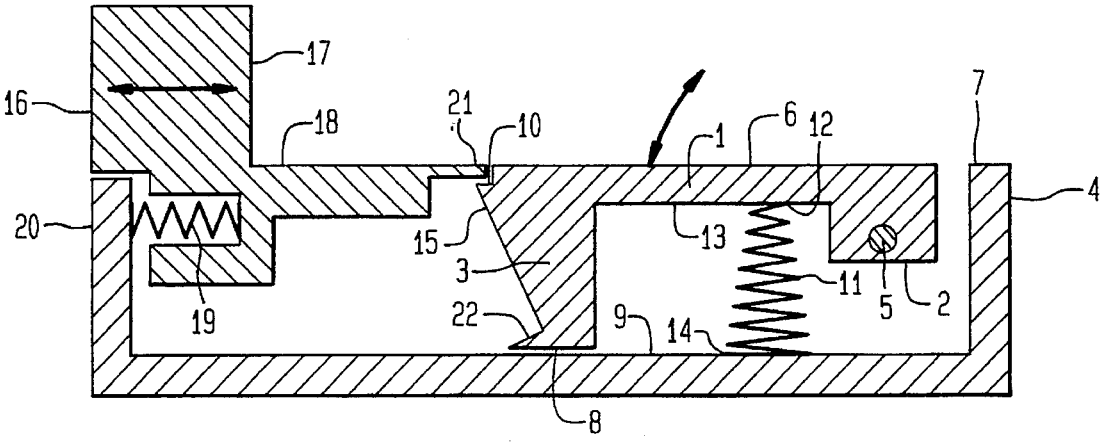
FIG. 1 is a sectional view of the basic invention showing the striker block in its first position engaging the door restraining member and holding it in its down position.

Referring to FIG. 1, door restraining member (1) having a pinned end (2) and a free end (3) is pinned to case (4) at its pinned end by pin (5) so that its motion is constrained to the direction of the arrows which is a rotation about pin (5). In a down position of restraining member (1), its upper surface (6)is essentially flush with top surface (7) of case (4) and its bottom surface (8) nearly abuts the floor (9) of case (4) to allow only minuscule movement of free end (3) beyond the down position towards floor (9). Upper surface (6) has a groove (10) machined into its upper surface at free end (3). Conical compression spring (11) having a small end (12) which is attached to the underside (13) of door restraining member (1), preferably with a flat head screw or other suitable means, and a large end (14) resting on floor (9), provides a means for biasing free end (3) away from floor (9) toward a second position of restraining member (1). Surface (15) of restraining member (1) protrudes about 2.5 cm. above top surface (7) of case (4) and is essentially perpendicular to the plane defined by top surface (7) when restraining member (1) is rotated about pin (5) to an up position.

Striker block (16) is slideably mounted in case (4) so that its motion is constrained to the direction of the arrows which is a translational motion toward or away from pin (5). The preferred means for achieving this is by providing a longitudinal groove in each of the sidewalls of case (4) and mating bearing surfaces in the form of laterally extending tabs on striker block (16) which slide in the grooves. However, the skilled artisan may substitute equivalent variations in the art for constraining a member to linear motion. Surface (17) of striker block (16) protrudes about 2.5 cm. above top surface (7) of case (4) and is essentially perpendicular to the plane defined by top surface (7) of case (4) and faces surface (15) when restraining member (1) is in said up position. Surface (18) of striker block (16) is essentially flush with top surface (7) of case (4). Compression spring (19) interposed between striker block (16) and a first end (20) of case (4) biases striker block (16) away from first end (20) toward a first position of striker block (16) where tongue (21) of striker block (16) engages groove (10) to prevent movement of restraining member (1) from said down to said up position by the urging of spring (11).

Figure 2:
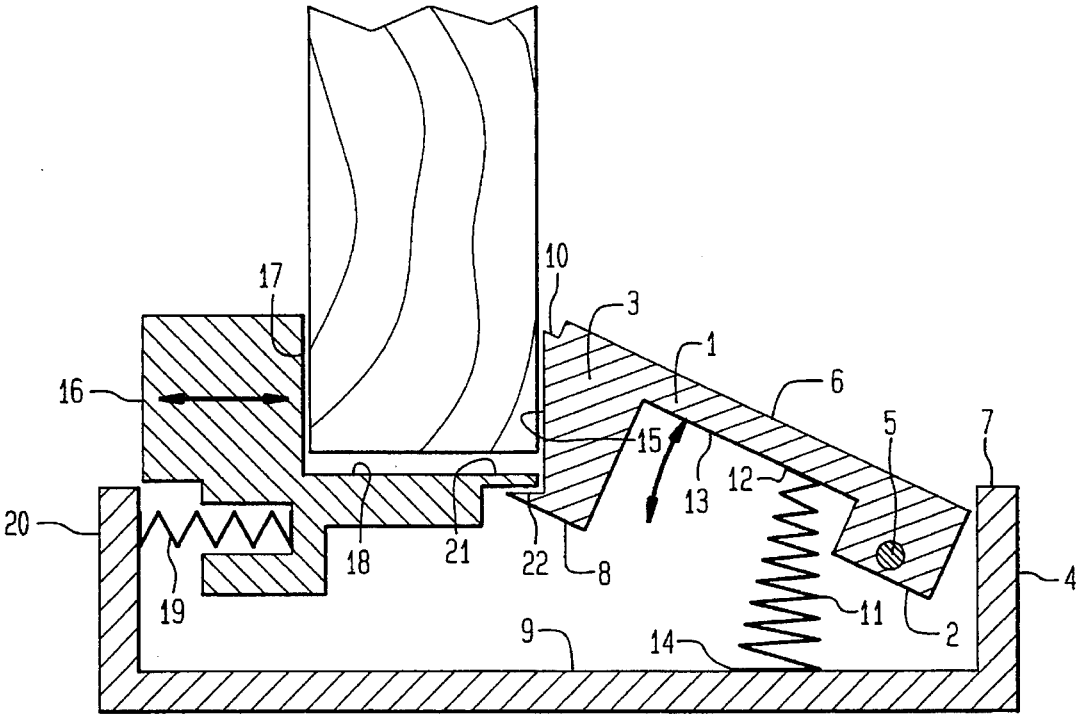
FIG. 2 is a sectional view of the basic invention showing the door restraining member in its up position, trapping a door between the door restraining member and the striker block.

Referring to FIG. 2, if striker block (16) is then momentarily pushed toward first end (20) by an outside force, tongue (21) disengages groove (10) releasing restraining member (1) to move toward said up position by the urging of spring (11). A means for stopping restraining member (1) at said up position such as catch (22) striking the underside of tongue (21) should be employed. Examples of alternatives to catch (22) include a correctly positioned stop at the pinned end of restraining member (1) or a tether of proper length connecting restraining member (1) to floor (9). Such alternatives and the like will perform essentially the same function in essentially the same way to achieve essentially the same result as catch (22) to stop restraining member (1) at said up position.

To reset the device, restraining arm (1) is pushed into said down position and during its travel from said up to said down position, surface (7) slides over tongue (21) pushing striker block (16) toward first end until said down position is reached. At that point, striker block (16) snaps away from first end (20), tongue (21) engages grove (10) at the urging of spring (11) and holds restraining member (1) in the down position.

To use the device as a doorstop, the spacing between facing surfaces (15) and (17) in FIG. 2 should be about the same as the thickness of the door this device is designed to operate with. For example, for a 3.75 cm. thick door, the spacing should be about 3.75 cm. Once the proper size of the device is determined for a particular door, a pocket sized to receive case (4), restrain it against horizontal motion and position it at a vertical height such that top surface (7) of case (4) is flush with the floor, is routed into the floor near the door's full open position and directed such that surface (17) faces the door and is essentially perpendicular to the motion of the door at this point.

Opening the door to its full open position will cause the door to pass over retaining member (1), hitting striker block (16) and triggering the aforementioned chain of events which will cause the door to be trapped in its open position between surfaces (15) and (16). To release the door, one merely steps on retaining member (1) to return it to its down position through the aforementioned chain of events applicable to this phase of operation. The door will now close.

Figure 3:
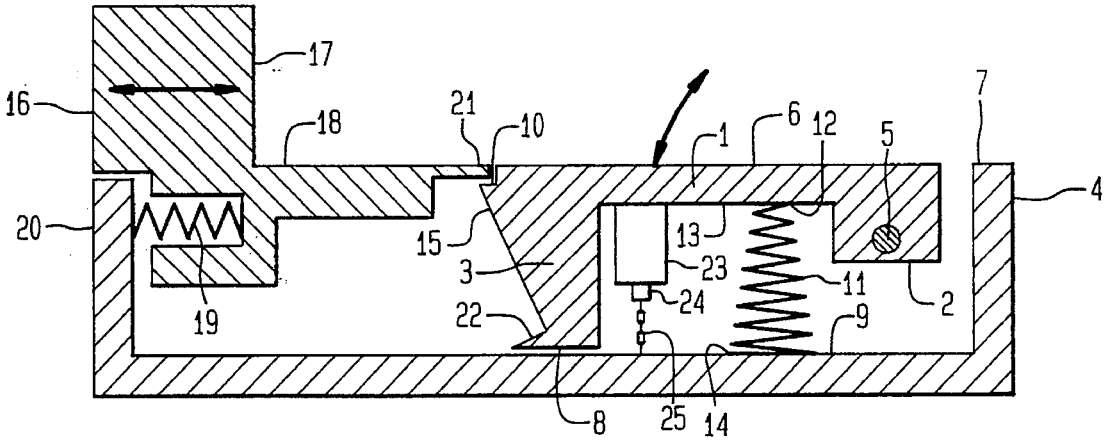
FIG. 3 is a sectional view of the invention depicted in FIG. 1 showing an optional solenoid installed.
Figure 4:
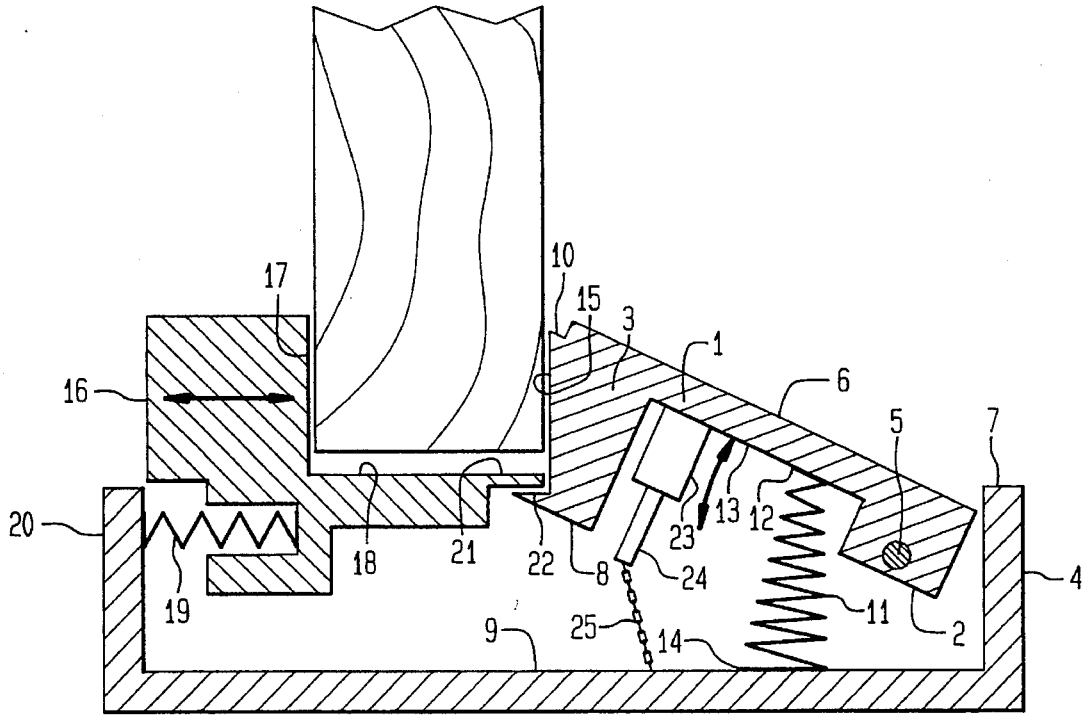
FIG. 4 is a sectional view of the invention depicted in FIG. 2 showing an optional solenoid installed.

Referring to FIGS. 3 and 4, a solenoid (23) is attached to retaining member (1) and its plunger (24) is attached to one end of a tether (25), the other end of tether (25) is attached to floor (9). If solenoid (23), is energized, retaining member (1) is drawn into or kept in its down position. This is useful because if this doorstop is installed in hotels, or other public buildings, doors which would normally close on their own accord can all be made to close in response to a signal from a fire signaling system. A pneumatically activated plunger is deemed equivalent to said solenoid.

Maintenance of this doorstop once installed is easy. The doorstop is simply removed from the routed pocket in the floor, emptied of accumulated dust and other debris, and placed back in the routed pocket. No other periodic maintenance is necessary. The preferred material for the doorstop is solid brass, but only for its aesthetics; those skilled in the art can select from a wide array of dimensionally stable, formable materials from which to construct this doorstop.

Although a specific preferred embodiment of the present invention has been described in detail above, it is readily apparent that those skilled in the art may make various modifications and changes to the present invention without departing from the spirit and scope thereof. These changes include but are not limited to substitution of equivalents, addition of elements or steps, or incorporation of the invention into other products. It is to be expressly understood that this invention is limited by the following claims:

What is claimed is:

1. A doorstop comprising:

a) a case, said case having a top surface, a floor, longitudinal sidewalls, a first end, a second end; and b) a striker block, said striker block positioned at said first end and constrained to move longitudinally from a first position to a second position in a direction from said first end towards said second end, said striker block having a portion projecting above said top surface; and c) a means for biasing said striker block towards said second position; and d) a retaining member, having a hinged end and a free end, said hinged end of said retaining member hingedly mounted to said case at said second end, and moveable from a down position in which said free end is below said top surface of said case to an up position in which said free end is projecting above said case; and e) a means for biasing said retaining member towards said up position; wherein said striker block in said second position engaging said free end of said retaining member in said down position, preventing movement of said retaining member to said up position, said striker block in said first position, releasing said free end of said retaining member to move to said up position urged by said means for biasing said retaining member toward said up position.

2. The doorstop as claimed in claim 1 wherein said means for biasing said striker block towards said second position comprises a compression spring located between said first end of said case and said striker block, said spring applying a biasing force to said striker block tending to push said striker block towards said second end.

3. The doorstop as claimed in claim 1 wherein said means for biasing said retaining member towards said up position comprises a compression spring located between said floor of said case and said retaining member, said spring applying a biasing force to said retaining member tending to push said retaining member towards said up position.

4. The doorstop as claimed in claim 3 further comprising a solenoid, said solenoid attached between said floor and said retaining member, said solenoid having an energized state and an off state, said solenoid in said energized state applying a force to said retaining member in said up position, overcoming said biasing force and drawing said retaining member from said up position to said down position.

* * * * *